US009055649B2

(12) United States Patent
Chen et al.

(10) Patent No.: US 9,055,649 B2
(45) Date of Patent: Jun. 9, 2015

(54) CONTROL CIRCUIT AND CONTROL METHOD OF LIGHT EMITTING DEVICE CIRCUIT

(71) Applicants: Pei-Yuan Chen, Taoyuan (TW); Yu-Min Chen, Taoyuan (TW); Leng-Nien Hsiu, Zhubei (TW)

(72) Inventors: Pei-Yuan Chen, Taoyuan (TW); Yu-Min Chen, Taoyuan (TW); Leng-Nien Hsiu, Zhubei (TW)

(73) Assignee: Richtek Technology Corporation, Chupei, HsinChu (TW)

( * ) Notice: Subject to any disclaimer, the term of this patent is extended or adjusted under 35 U.S.C. 154(b) by 182 days.

(21) Appl. No.: 13/974,914

(22) Filed: Aug. 23, 2013

(65) Prior Publication Data

US 2014/0077703 A1 Mar. 20, 2014

Related U.S. Application Data

(60) Provisional application No. 61/703,208, filed on Sep. 19, 2012.

(51) Int. Cl.
*H05B 37/00* (2006.01)
*H05B 33/08* (2006.01)

(52) U.S. Cl.
CPC ..... *H05B 33/089* (2013.01); *H05B 33/0803* (2013.01)

(58) Field of Classification Search
None
See application file for complete search history.

(56) References Cited

U.S. PATENT DOCUMENTS

| | | | | |
|---|---|---|---|---|
| 8,836,241 | B2 * | 9/2014 | Shiu et al. | 315/307 |
| 2011/0080110 | A1 * | 4/2011 | Nuhfer et al. | 315/291 |
| 2011/0248637 | A1 * | 10/2011 | Mitsuyasu et al. | 315/178 |
| 2014/0091714 | A1 * | 4/2014 | Sutardja et al. | 315/122 |

* cited by examiner

*Primary Examiner* — Cassandra Cox
(74) *Attorney, Agent, or Firm* — Tung & Associates

(57) ABSTRACT

The present invention discloses a control circuit and a control method of a light emitting device circuit. When the light emitting device circuit is normally connected in normal operation, an output current is regulated to a predetermined current. When the light emitting device circuit is removed, an output voltage is regulated to a predetermined voltage. When the light emitting device circuit is reconnected, the output current is regulated to the predetermined current. The output voltage is at or above a level when the light emitting device circuit is normally connected in normal operation, and the predetermined voltage is lower than this level.

12 Claims, 6 Drawing Sheets

CONTROL CIRCUIT AND CONTROL METHOD OF LIGHT EMITTING DEVICE CIRCUIT

CROSS REFERENCE

The present invention claims priority to U.S. 61/703208, filed on Sep. 19, 2012.

BACKGROUND OF THE INVENTION

1. Field of Invention

The present invention relates to a control circuit and a control method of a light emitting device circuit; particularly, it relates to such control circuit and control method with a hot swapping protection function.

2. Description of Related Art

FIG. 1 shows a schematic diagram of a prior art light emitting diode (LED) power control circuit 100. As shown in FIG. 1, the LED power control circuit 100 controls an LED circuit 10. The LED power control circuit 100 includes a control circuit 110, a power stage circuit 120, and a current sense circuit 130. The control circuit 110 is connected to the current sense circuit 130 to receive a current feedback signal FB. The control circuit 110 generates a control signal GATE according to the current feedback signal FB, to control a power switch of the power stage circuit 120 accordingly such that an input voltage Vin is converted to an output voltage Vout, and an output current is provided to the LED circuit 10. VCC is a power supply voltage of the control circuit 110, and GND is a ground level of the circuitry. The power stage circuit 120 may be a synchronous or asynchronous buck, boost, inverting, buck-boost, or inverting-boost power stage circuit as shown in FIGS. 2A-2J.

In normal operation, the LED power control circuit 100 regulates the output current at a fixed predetermined current. When the LED circuit 10 is suddenly removed during the normal operation without shutting down the LED power control circuit 100, the control circuit 110 will continue trying to regulate the output current at the fixed determined current, causing not only unnecessary power consumption but also serious danger because the output voltage Vout may rise to a dangerous level. At such dangerous level of the output voltage Vout, if the LED circuit 10 is reconnected to the power stage circuit 120, an instant surge current may be generated, which may damage circuit devices and shorten lifetime of the circuitry.

In view of above, the present invention proposes a control circuit and a control method of a light emitting device circuit with hot swapping protection function ("hot swapping" meaning to remove and/or reconnect an LED circuit while power ON).

SUMMARY OF THE INVENTION

From one perspective, the present invention provides a control method of a light emitting device circuit, wherein the light emitting device circuit is coupled to a power stage circuit in normal operation, and the power stage circuit converts an input voltage to an output voltage according to a control signal, to provide an output current to the light emitting device circuit when the light emitting device circuit is in normal operation, the control method comprising: when the light emitting device circuit is normally connected in normal operation, performing current regulation to regulate the output current to a predetermined current, wherein the output current is a controlled object; when the light emitting device circuit is removed (a removal condition) during normal operation, generating a hot swapping signal indicating the removal condition; after generating the hot swapping signal indicating the removal condition, switching the controlled object to the output voltage, and performing voltage regulation to regulate the output voltage to a predetermined voltage, wherein the output voltage is the controlled object; when the light emitting device circuit is reconnected (a reconnection condition) in the removal condition, generating a hot swapping signal indicating the reconnection condition; and after generating the hot swapping signal indicating the reconnection condition, switching the controlled object to the output current, and performing current regulation to regulate the output voltage to the predetermined current, wherein the output current is the controlled object.

In one preferable embodiment, the hot swapping signal indicating the reconnection condition is generated when the output current is not zero for a predetermined period of time after the light emitting device circuit is reconnected.

In one preferable embodiment, the hot swapping signal indicating the removal condition and the hot swapping signal indicating the reconnection condition are generated according to a signal related to the output voltage and/or a signal related to the output current.

In one preferable embodiment, the step of generating the hot swapping signal indicating the removal condition includes: comparing the output voltage with a removal reference signal; and the step of generating the hot swapping signal indicating the reconnection condition includes: comparing the output voltage with a reconnection reference signal.

In one preferable embodiment, the step of generating the hot swapping signal indicating the removal condition includes: determining whether to generate the hot swapping signal indicating the removal condition according to whether the output current is zero; and the step of generating the hot swapping signal indicating the reconnection condition includes: determining whether to generate the hot swapping signal indicating the reconnection condition according to whether the output current is no longer zero after the output current is zero.

In one preferable embodiment, the predetermined voltage is lower than a normal operating level of the output voltage when the light emitting device circuit is in the normal operation and normally connected.

From another perspective, the present invention provides a control circuit of a light emitting device circuit for generating a control signal to control a power stage circuit such that an input voltage is converted to an output voltage, and in normal operation, an output current is provided to the light emitting device circuit, the control circuit comprising: a determination circuit, for determining whether the light emitting device circuit is normally connected or is removed in normal operation, and for generating a hot swapping signal indicating whether the light emitting device circuit is normally connected or is removed; and a control signal generation circuit, which is coupled to the determination circuit, wherein when the hot swapping signal indicates that the light emitting device circuit is normally connected, the control signal generation circuit generates the control signal according to a voltage feedback signal related to the output voltage, so as to regulate the output voltage at a predetermined voltage, and when the hot swapping signal indicates that the light emitting device circuit is removed, the control signal generation circuit generates the control signal according to a current feedback signal related to the output current, so as to regulate the output current at a predetermined current.

In one preferable embodiment, the determination circuit generates the hot swapping signal according to a signal related to the output voltage and/or a signal related to the output current.

In another preferable embodiment, the determination circuit includes: a first comparator circuit for comparing the signal related to the output voltage with a removal reference signal; and a second comparator circuit for comparing the signal related to the output voltage with a reconnection reference signal.

In another preferable embodiment, the control signal generation circuit includes: a first error amplifier circuit, for comparing the current feedback signal with a current reference signal to generate a first output; a second error amplifier circuit, for comparing the voltage feedback signal with a voltage reference signal to generate a second output; and a pulse signal generation circuit, which is coupled to the first error amplifier circuit and the second error amplifier circuit, for comparing the first output or the second output with a saw-tooth waveform signal, to generate a pulse width modulation signal with a fixed frequency or a fixed pulse width signal with a variable frequency as the control signal.

In another preferable embodiment, the first output of the first error amplifier circuit and the second output of the second error amplifier circuit are coupled to a common node and the pulse signal generation circuit is coupled to the common node, wherein the voltage of the common node is determined by a higher one of the first output and the second output.

In another preferable embodiment, the predetermined voltage is lower than a normal operating level of the output voltage when the light emitting device circuit is in the normal operation and normally connected.

The objectives, technical details, features, and effects of the present invention will be better understood with regard to the detailed description of the embodiments below.

DESCRIPTION OF THE PREFERRED EMBODIMENTS

Figure 1:
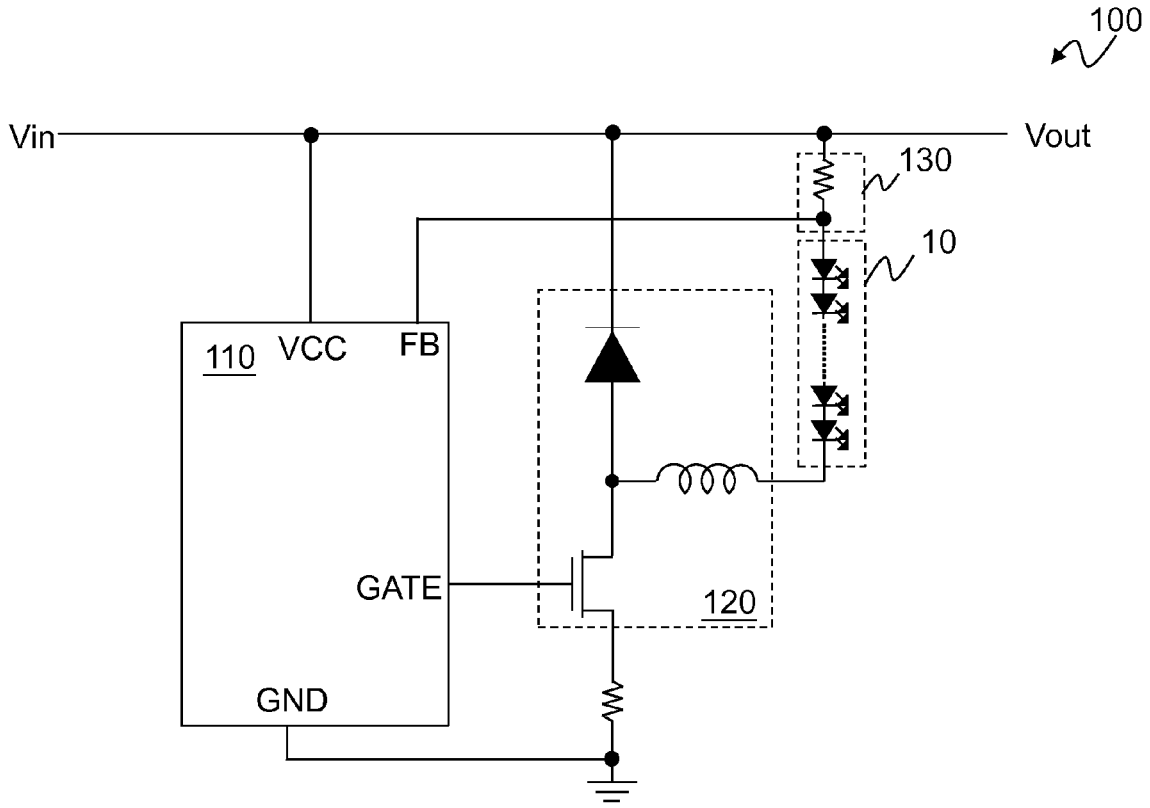
Fig. 1 (Prior Art)
FIG. 1 shows a schematic diagram of a prior art light emitting diode (LED) power control circuit 100.
Figure 2A:
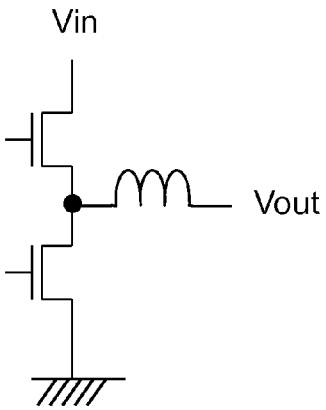
FIGS. 2A-2J show synchronous and asynchronous buck, boost, inverting, buck-boost, and inverting-boost power stage circuits.
Figure 2B:
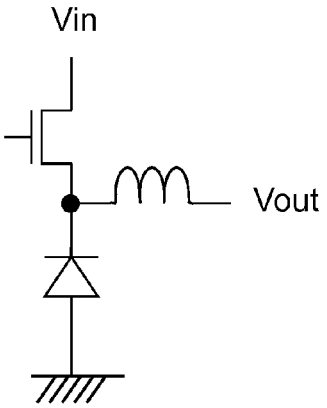
Figure 2C:
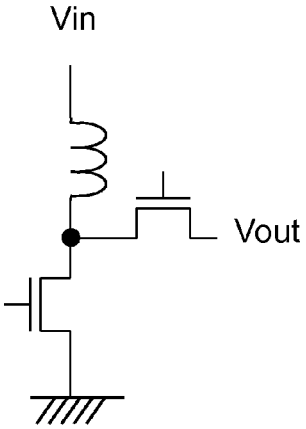
Figure 2D:
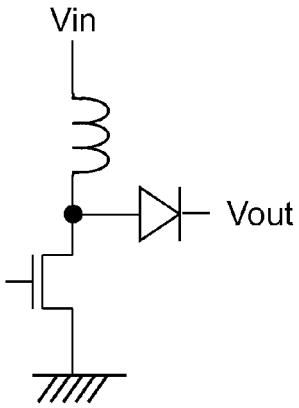
Figure 2E:
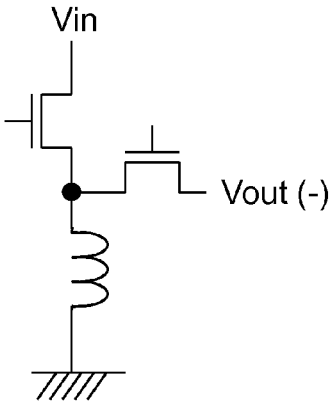
Figure 2F:
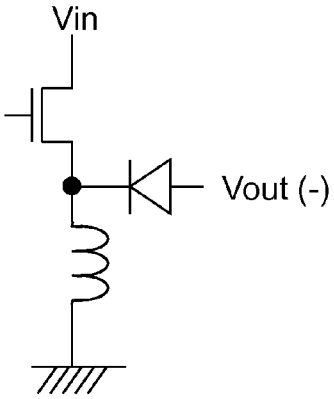
Figure 2G:
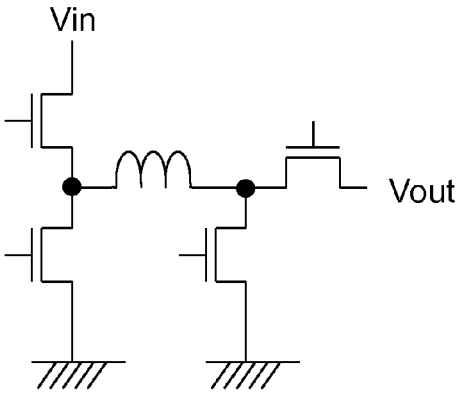
Figure 2H:
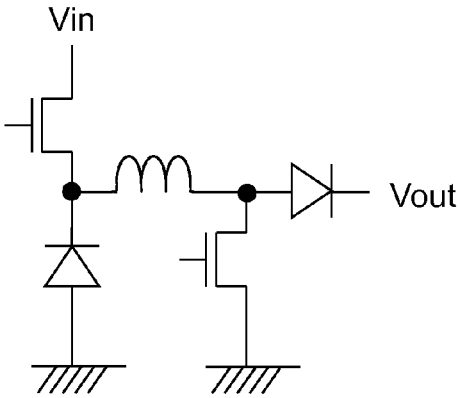
Figure 2I:
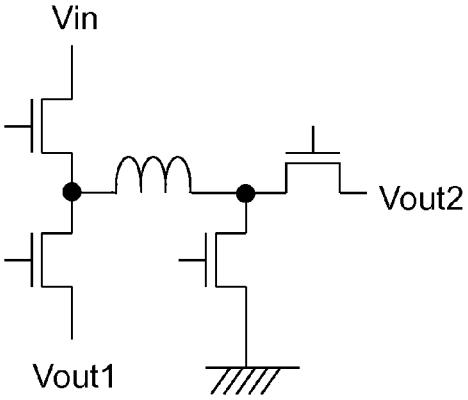
Figure 2J:
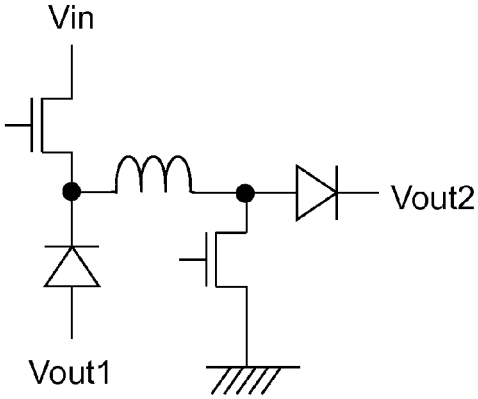
Figure 3:
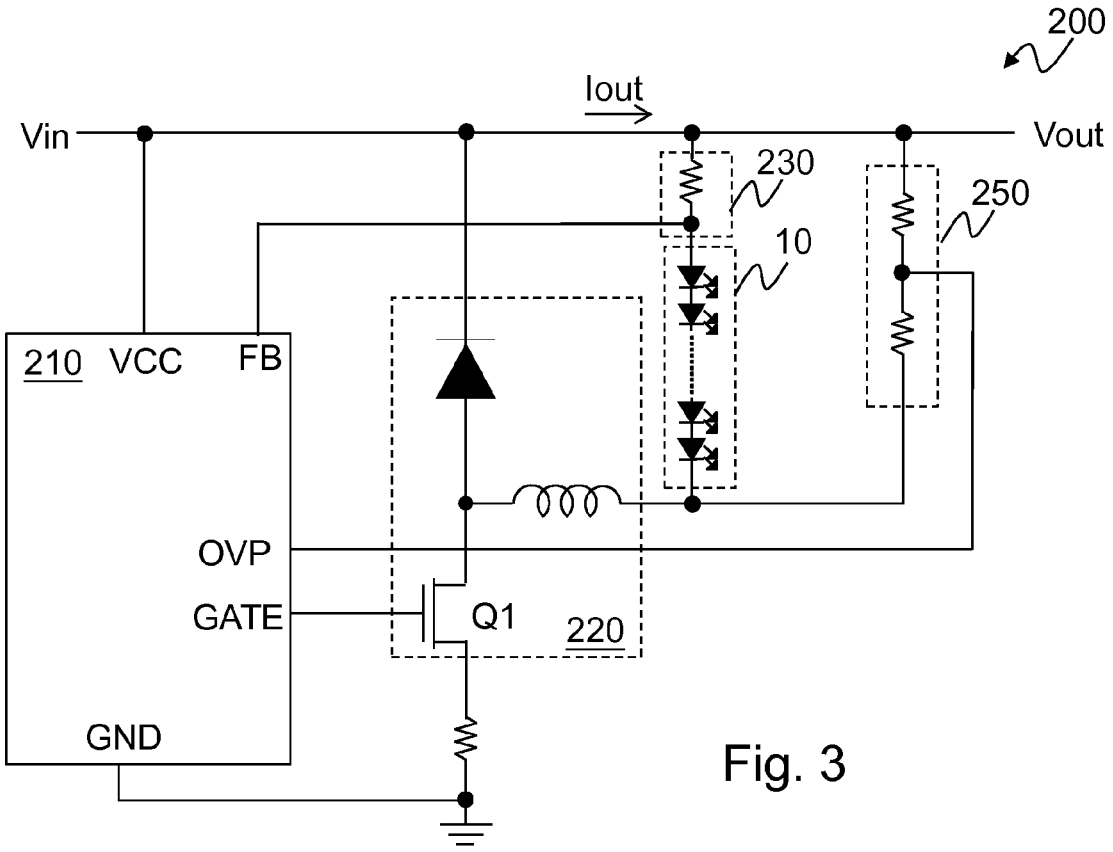
FIG. 3 shows a first embodiment of the present invention.

Please refer to FIG. 3 for a first embodiment according to the present invention. As shown in FIG. 3, in an LED power control circuit 200, a control circuit 210 generates a control signal GATE according to a current feedback signal FB in normal operation to feedback control the power stage circuit 220. A power switch Q1 of the power stage circuit 220 operates according to the control signal GATE to convert an input voltage Vin to an output voltage Vout, and to provide an output current Iout to the LED circuit 10. The power stage circuit 220 is for example but not limited to the buck power stage circuit as shown in FIG. 3. The power stage circuit 220 may also be the synchronous or asynchronous buck, boost, inverting, buck-boost, or inverting-boost power stage circuit as shown in FIGS. 2A-2J. The LED circuit 10 is not limited to a single LED string as shown in the figure, but may include plural light emitting device strings connected in parallel. The current feedback signal FB is generated by for example but not limited to a current sense circuit 230 which is coupled to the LED circuit 10. In this embodiment, because the current feedback signal FB is relative to the input voltage Vin, the control circuit 210 needs to obtain information related to the input voltage. In one preferable embodiment, the power supply VCC of the control circuit 210 is the input voltage Vin, such that the control circuit may obtain both electric power and information related to the input voltage. The output current Iout is regulated at for example but not limited to a predetermined current, such that a stable current may be provided to the LED circuit 10. This embodiment is different from the prior art LED power control circuit 100 in that, the LED power control circuit 200 further includes an output voltage sense circuit 250 for generating an over voltage protection signal OVP which is received by the control circuit 210, to determine whether the LED circuit 10 is normally connected or is removed during normal operation. When the LED circuit 10 is removed during normal operation, the LED power control circuit 200 adjusts the control signal GATE according to the over voltage protection signal (OVP), such that the LED power control circuit 200 enters a constant voltage control mode wherein the output voltage Vout is regulated at a predetermined relatively lower level. Therefore, after the LED circuit 10 is removed in the normal operation, the power consumption can be reduced, and the surge current caused by the reconnection of the LED circuit 10 can also be reduced because of the relatively lower voltage level. More specific embodiments of the control circuit 210 will be described in details later.

Figure 4:
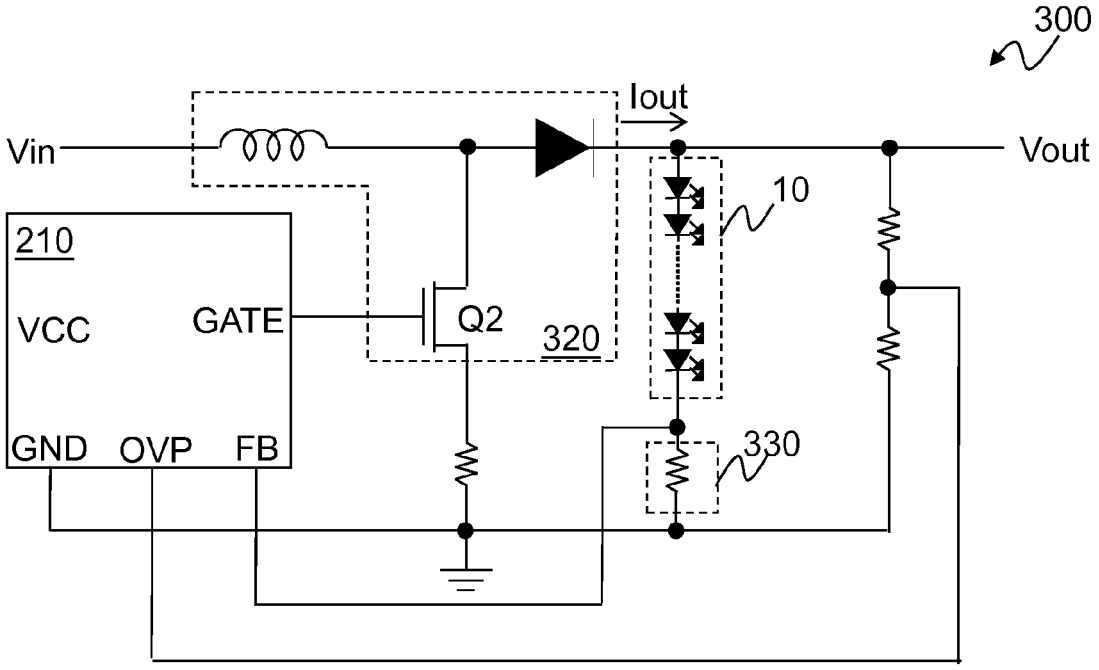
FIG. 4 shows a second embodiment of the present invention.

FIG. 4 shows a second embodiment of the present invention. As shown in FIG. 4, the control circuit 210 of an LED power control circuit 300 generates the control signal GATE according to the current feedback signal FB, and feedback controls a power stage circuit 320. The control circuit 210 generates the control signal GATE, controlling a power switch Q2 of the power stage circuit 320 to convert an input voltage Vin to an output voltage Vout, and provide an output current Iout to the LED circuit 10. This embodiment is different from the first embodiment in that, the power stage circuit 320 is for example the boost power stage circuit as shown in the figure, which shows that the present invention is not limited to the power stage circuit 220 as the first embodiment. The power stage circuit 320 may also be the synchronous or asynchronous buck, boost, inverting, buck-boost, or inverting-boost power stage circuit as shown in FIGS. 2A-2J. Besides, in this embodiment, the current feedback signal FB may be generated by for example a current sense circuit 330 which is connected to a reverse terminal of the LED circuit 10 in series, instead of the current sense circuit 230 which is connected to a forward terminal of the LED circuit 10 in series. Because the current sense signal FB in this embodiment is relative to ground level, the control circuit 210 does not need to obtain information related to the input voltage, and the power supply VCC of the control circuit 310 does not need to be the input voltage Vin, but may be another power source.

Figure 5:
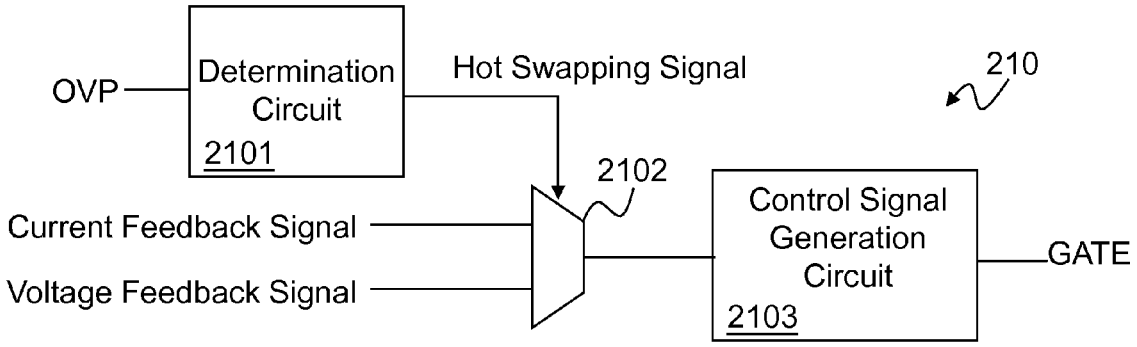
FIG. 5 shows a third embodiment the present invention.

FIG. 5 shows a third embodiment of the present invention. This embodiment shows a specific embodiment of the control circuit 210. As shown in FIG. 5, the control circuit 210 includes a determination circuit 2101, a selection circuit 2102, and a control signal generation circuit 2103. When the LED circuit 10 is normally connected during normal operation, the control signal generation circuit 2103 generates the control signal GATE according to the current feedback signal, i.e., in this condition, the LED power control circuit 200 or 300 enters a constant current control mode and performs current feedback control to regulate the output current at the predetermined current. The current feedback signal may be the current feedback signal FB or its related signal. When the LED circuit 10 is removed during normal operation, referring to FIGS. 3 and 4, because the output current Iout can not flow through the LED circuit 10 and charges are accumulated at the output terminal, the output voltage Vout keeps increasing. The over voltage protection signal OVP is a signal related to the output voltage Vout, and the determination circuit 2101 determines whether the output voltage Vout is too high according to the over voltage protection signal OVP. When the determination circuit 1201 determines that the output voltage Vout is too high according to the over voltage protection signal OVP, the determination circuit 1201 generates a hot swapping signal to indicate a removal condition of the LED circuit 10, such that the selection circuit 2102 selects the voltage feedback signal instead of the current feedback signal, and the control signal generation circuit 2103 generates the control signal GATE according to the voltage feedback signal instead of the current feedback signal, i.e., in this condition, the LED power control circuit 200 or 300 enters the constant voltage control mode and performs voltage feedback control to regulate the output voltage at a predetermined voltage. The predetermined voltage may be a safe level which will not endanger a human body and the circuitry, and at such level the LED power control circuit 200 or 300 will not consume high power but only maintains its basic operation, such that when the LED circuit 10 is reconnected, the LED power control circuit 200 or 300 can resume normal operation quickly. The voltage feedback signal for example may be the over voltage protection signal OVP or its related signal. The safety level for example may be a level lower than the normal operating level of the output voltage (i.e., the level of the output voltage when the light emitting device circuit is normally connected in normal operation (to be discussed later with reference to FIG. 7).

When the LED circuit 10 is reconnected after it is removed, the hot swapping signal generated by the determination circuit 2101 indicates the connection. Because the output voltage Vout is regulated at a safe predetermined level (the predetermined voltage) in the LED removal condition, the instant surge current will not be too large when the LED circuit 10 is reconnected. Besides, the LED power control circuit can resume normal operation quickly when the LED circuit 10 is reconnected because the circuit keeps operating in the LED removal condition. A current path is formed when the LED circuit 10 is reconnected, such that the output voltage Vout decreases because of the current flowing through the LED circuit 10. The determination circuit 2101 determines that the LED circuit 10 is reconnected according to the over voltage protection signal OVP, and generates the hot swapping signal indicating such reconnection such that the selection circuit 2102 selects the current feedback signal as the input to the control signal generation circuit 2103. The control signal generation circuit 2103 generates the control signal GATE according to the current feedback signal, i.e., the operation mode is changed to the constant current control mode (normal operation) from the constant voltage control mode (LED removal condition), and the output current Iout is regulated at the predetermined current.

Figure 6:
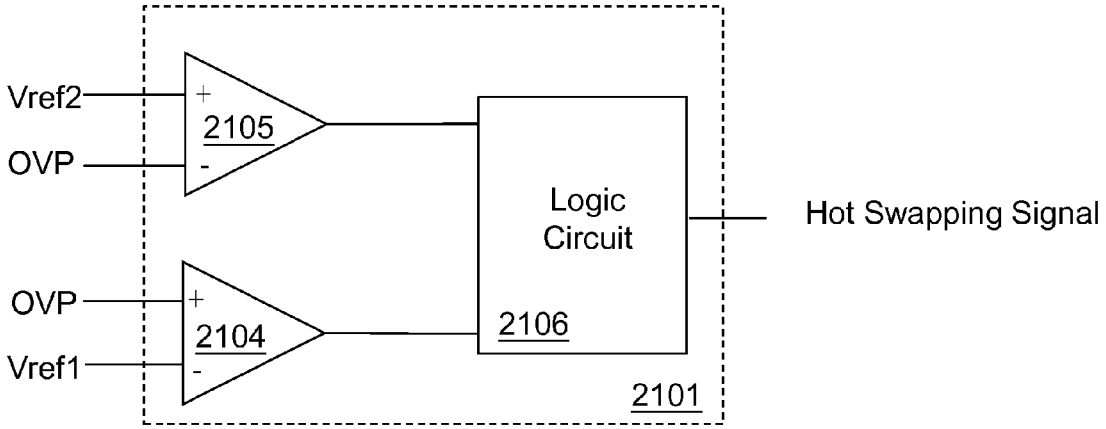
FIG. 6 shows a fourth embodiment of the present invention.

FIG. 6 shows a fourth embodiment of the present invention. This embodiment shows a more specific embodiment of the determination circuit 2101. As shown in FIG. 6, in this embodiment, the determination circuit 2101 includes comparator circuits 2104 and 2105, and a logic circuit 2106. The comparator circuit 2104 compares the over voltage protection signal OVP with a removal reference signal Vref1, to determine whether the output voltage Vout exceeds a high level, which indicates that the LED circuit 10 is removed. The comparator circuit 2105 compares the over voltage protection signal OVP with a reconnection reference signal Vref2, to determine whether the output voltage Vout is below a low level, which indicates that the LED circuit 10 is reconnected. The logic circuit 2106 may be designed accordingly. In another embodiment, the logic circuit 2106 may be omitted, and the hot swapping signal can be a multi-digit signal.

Figure 7:
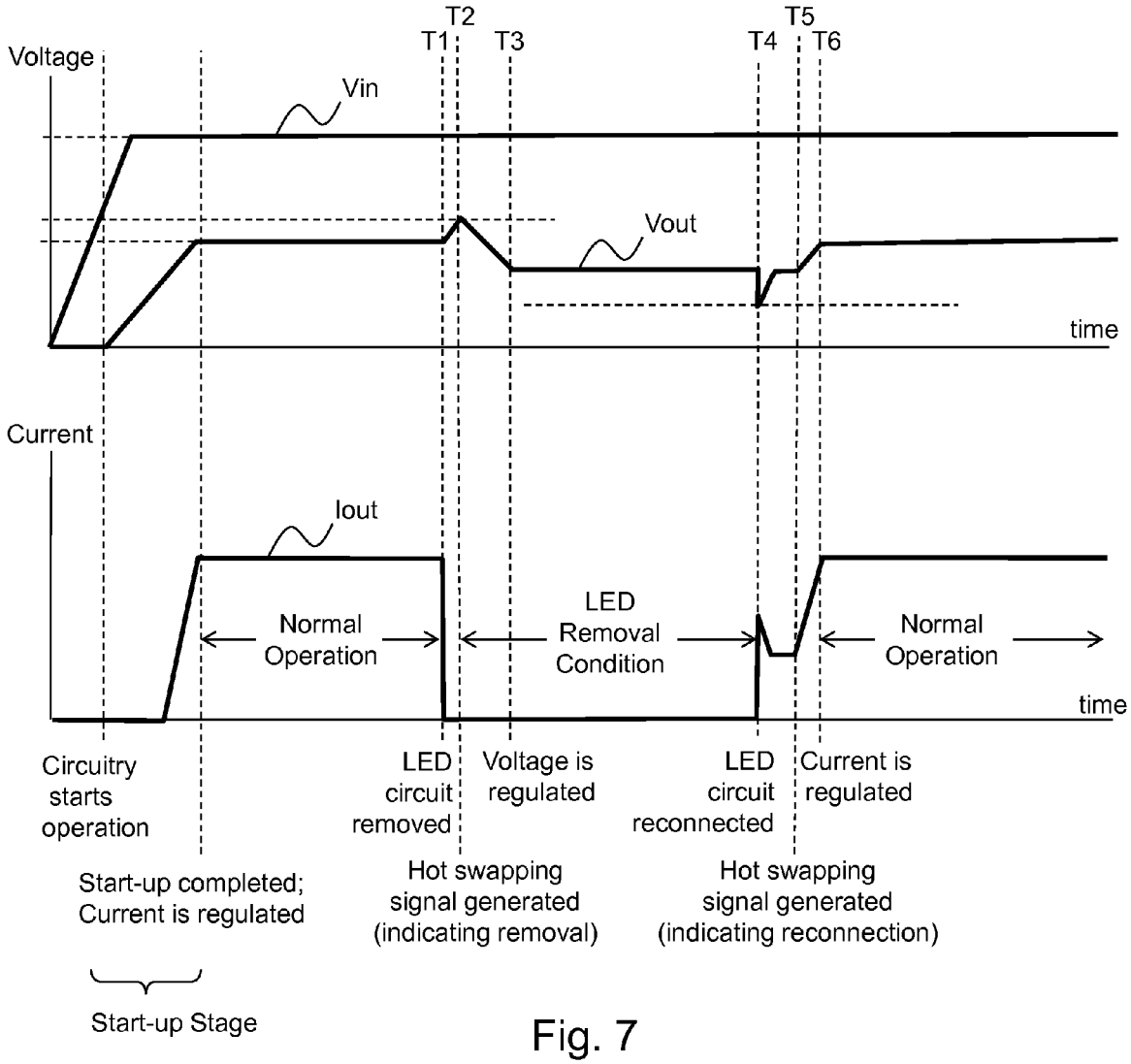
FIG. 7 shows signal waveforms of the input voltage Vin, the output voltage Vout, and the output current Iout.

FIG. 7 shows signal waveforms of the input voltage Vin, the output voltage Vout, and the output current Iout. As shown in FIG. 7, when the circuitry starts operation, the input voltage Vin and the output voltage Vout increase, and the LED power control circuit regulates the output current Iout at the predetermined current; in this period, the output current is the controlled object. At time point T1, the LED circuit is removed and the output current Iout drops to zero; the output voltage Vout begins increasing from this time point. At time point T2, the output voltage Vout exceeds a threshold (referring to FIG. 6 of the fourth embodiment, the over voltage protection signal OVP exceeds the removal reference signal Vref1), such that the hot swapping signal indicating the LED removal condition is generated. The LED power control circuit enters the constant voltage control mode at time point T2, and it is the output voltage Vout instead of the output current Iout that is to be regulated (i.e., in the period after time point T2, the output voltage is the controlled object). At time point T3, the output voltage Vout is controlled and stabilized at the predetermined voltage which has a relatively lower level.

Figure 9:
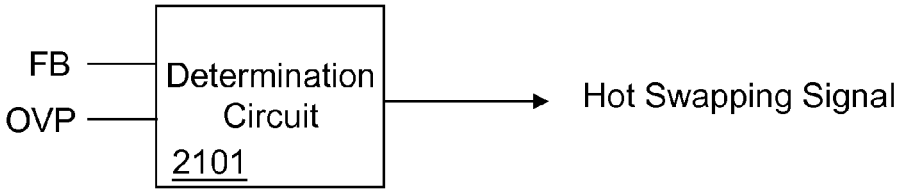
FIG. 9 shows a sixth embodiment of the present invention.

The LED circuit is reconnected at time point T4. When the LED circuit is reconnected, the output voltage Vout drops (referring to FIG. 6 of the fourth embodiment, the over voltage protection signal OVP is lower than the reconnection reference signal Vref2), and the output current Iout increases because of the instant surge current. In one embodiment, the hot swapping signal indicating the reconnection may be generated at this time point T4. In the present embodiment, the hot swapping signal is generated after it is confirmed that the output current Iout is not zero for a predetermined period of time after the light emitting device circuit is reconnected (i.e., after time point T4, there is a predetermined period of time for confirmation, so the hot swapping signal indicating reconnection is generated at time point T5). For confirming that the output current Iout is not zero, the determination circuit 2101 needs to obtain information related to the output current Iout, and in this case the determination circuit 2101 can be embodied as shown in FIG. 9. The LED power control circuit then enters the constant current control mode at time point T5, and it is the output current Iout instead of the output voltage Vout that is to be regulated (i.e., in the period after time point T5, the output current is the controlled object). At time point T6, the output current Iout is controlled and stabilized at the predetermined current.

Figure 8:
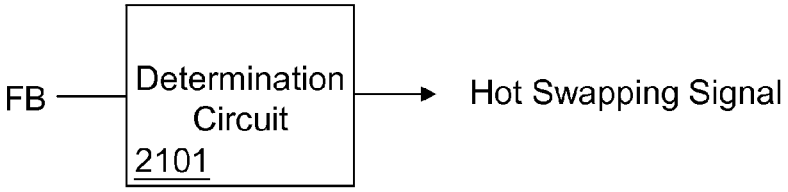
FIG. 8 shows a fifth embodiment of the present invention.

In the aforementioned embodiments, the hot swapping signal is generated according to the over voltage protection signal, but the present invention is not limited to that. Note that, according to the present invention, the hot swapping signal can be generated according to any signal related to the output voltage (including but not limited to the output voltage itself) and/or any signal related to the output current (including but not limited to the output current itself). For example, the hot swapping signal indicating the LED removal condition may be generated when the output current drops to zero during normal operation (but not so during the start-up stage, i.e., such determination may be disregarded in the start-up stage), and the hot swapping signal indicating reconnection may be generated when the output current is no more zero in the LED removal condition. In this example, the determination circuit 2101 needs to obtain information related to the output current instead of the information related to the output voltage, as shown by the embodiment in FIG. 8.

Figure 10:
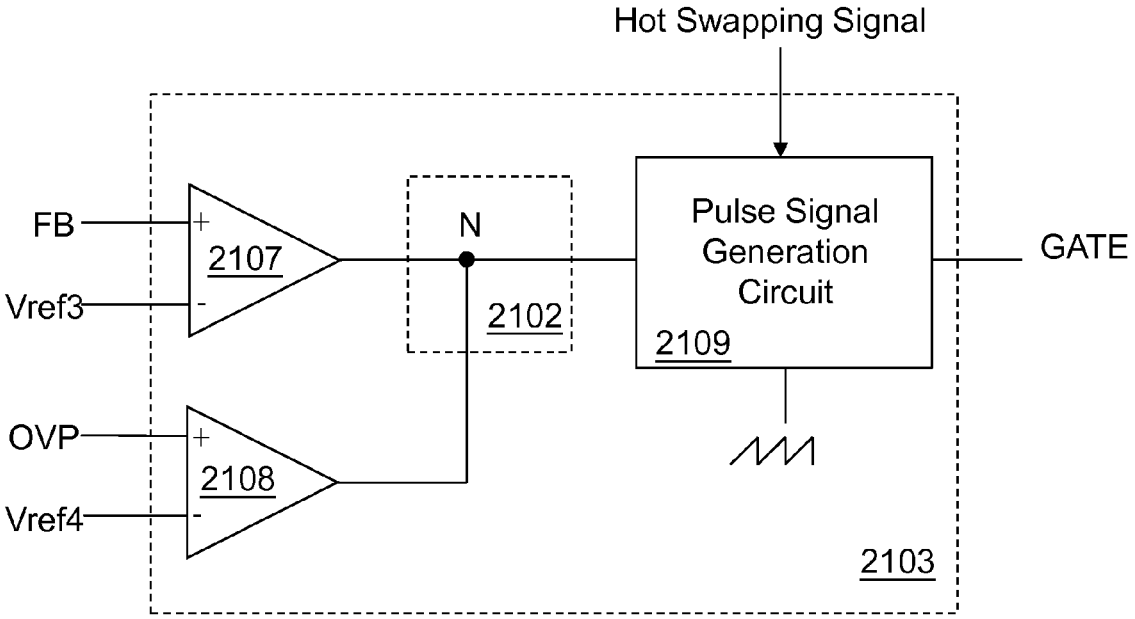
FIG. 10 shows a seventh embodiment of the present invention.

In the third embodiment shown in FIG. 5, the selection circuit 2102 is shown for explaining the concept of the present invention; in actual implementation of the concept, the selection circuit 2102 may be omitted, or does not need to be a physical circuit or device. For example, FIG. 10 shows a seventh embodiment of the present invention. In this embodiment, the control signal generation circuit 2103 includes an error amplifier circuits 2107 and 2108, and a pulse signal generation circuit 2109. The error amplifier circuit 2107 compares the current feedback signal FB with a current reference signal Vref3, and the error amplifier circuit 2108 compares the over voltage protection signal OVP with a voltage reference signal Vref4. By proper arrangement of the current reference signal Vref3, the voltage reference signal Vref4, the ratio of the current feedback signal FB to the output current Iout, and the ratio of the over voltage protection signal OVP to the output voltage Vout, it can be thus arranged that the output of the error amplifier circuit 2107 is higher than the output of the error amplifier circuit 2108 when the LED circuit 10 is normally connected in normal operation, and the output of the error amplifier circuit 2108 is higher than the output of the error amplifier circuit 2107 when the LED circuit 10 removed. Thus, the voltage at the node N is determined by a higher one between the outputs of the error amplifier circuits 2107 and 2108, or from another perspective, the node N may be considered as an embodiment of the selection circuit, because it provides a function of selection (selecting the higher voltage).

There are various embodiments of the pulse signal generation circuit 2109. For example, the pulse signal generation circuit 2109 can compare a signal at the node N with a sawtooth waveform, to generate a pulse width modulation signal with a fixed frequency or a fixed pulse width signal with a variable frequency as the control signal GATE. The control signal GATE, which is generated by the pulse signal generation circuit 2109, maybe adjusted according to the hot swapping signal. For example, the pulse signal generation may stop for a period of time according to the hot swapping signal indicating the LED removal condition, such that the output voltage Vout decreases rapidly.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a device or circuit which does not substantially influence the primary function of a signal can be inserted between any two devices or circuits in the shown embodiments, such as a switch or the like, so the term. "couple" should include direct and indirect connections. For another example, a light emitting device is not limited to the LED as shown in the embodiments of the present, but the light emitting device may be any light emitting device driven by current. For another example, the meanings of the high and low levels of a digital signal are interchangeable, with corresponding amendment of the circuits processing these signals. For another example, the positive and negative input terminals of the comparator circuits are interchangeable, with corresponding amendment of the circuits processing these signals. In view of the foregoing, the spirit of the present invention should cover all such and other modifications and variations, which should be interpreted to fall within the scope of the following claims and their equivalents.

What is claimed is:

1. A control method of a light emitting device circuit, wherein the light emitting device circuit is coupled to a power stage circuit in normal operation, and the power stage circuit converts an input voltage to an output voltage according to a control signal, to provide an output current to the light emitting device circuit when the light emitting device circuit is in normal operation, the control method comprising:

when the light emitting device circuit is normally connected in normal operation, performing current regulation to regulate the output current to a predetermined current, wherein the output current is a controlled object;

when the light emitting device circuit is removed (a removal condition) during normal operation, generating a hot swapping signal indicating the removal condition;

after generating the hot swapping signal indicating the removal condition, switching the controlled object to the output voltage, and performing voltage regulation to regulate the output voltage to a predetermined voltage, wherein the output voltage is the controlled object;

when the light emitting device circuit is reconnected (a reconnection condition) in the removal condition, generating a hot swapping signal indicating the reconnection condition; and after generating the hot swapping signal indicating the reconnection condition, switching the controlled object to the output current, and performing current regulation to regulate the output voltage to the predetermined current, wherein the output current is the controlled object.

2. The control method of claim 1, wherein the hot swapping signal indicating the reconnection condition is generated when the output current is not zero for a predetermined period of time after the light emitting device circuit is reconnected.

3. The control method of claim 1, wherein the hot swapping signal indicating the removal condition and the hot swapping signal indicating the reconnection condition are generated according to a signal related to the output voltage and/or a signal related to the output current.

4. The control method of claim 1, wherein the step of generating the hot swapping signal indicating the removal condition includes: comparing the output voltage with a removal reference signal; and the step of generating the hot swapping signal indicating the reconnection condition includes: comparing the output voltage with a reconnection reference signal.

5. The control method of claim 1, wherein the step of generating the hot swapping signal indicating the removal condition includes: determining whether to generate the hot swapping signal indicating the removal condition according to whether the output current is zero; and the step of generating the hot swapping signal indicating the reconnection condition includes: determining whether to generate the hot swapping signal indicating the reconnection condition according to whether the output current is no longer zero after the output current is zero.

6. The control method of claim 1, wherein the predetermined voltage is lower than a normal operating level of the output voltage when the light emitting device circuit is in the normal operation and normally connected.

7. A control circuit of a light emitting device circuit, for generating a control signal to control a power stage circuit such that an input voltage is converted to an output voltage, and in normal operation, an output current is provided to the light emitting device circuit, the control circuit comprising:

a determination circuit, for determining whether the light emitting device circuit is normally connected or is removed in normal operation, and for generating a hot swapping signal indicating whether the light emitting device circuit is normally connected or is removed; and a control signal generation circuit, which is coupled to the determination circuit, wherein when the hot swapping signal indicates that the light emitting device circuit is normally connected, the control signal generation circuit generates the control signal according to a voltage feedback signal related to the output voltage, so as to regulate the output voltage at a predetermined voltage, and when the hot swapping signal indicates that the light emitting device circuit is removed, the control signal generation circuit generates the control signal according to a current feedback signal related to the output current, so as to regulate the output current at a predetermined current.

8. The control circuit of claim 7, wherein the determination circuit generates the hot swapping signal according to a signal related to the output voltage and/or a signal related to the output current.

9. The control circuit of claim 8, wherein the determination circuit includes:

a first comparator circuit for comparing the signal related to the output voltage with a removal reference signal; and a second comparator circuit for comparing the signal related to the output voltage with a reconnection reference signal.

10. The control circuit of claim 7, wherein the control signal generation circuit includes:

a first error amplifier circuit, for comparing the current feedback signal with a current reference signal to generate a first output;

a second error amplifier circuit, for comparing the voltage feedback signal with a voltage reference signal to generate a second output; and a pulse signal generation circuit, which is coupled to the first error amplifier circuit and the second error amplifier circuit, for comparing the first output or the second output with a saw-tooth waveform signal, to generate a pulse width modulation signal with a fixed frequency or a fixed pulse width signal with a variable frequency as the control signal.

11. The control circuit of claim 10, wherein the first output of the first error amplifier circuit and the second output of the second error amplifier circuit are coupled to a common node and the pulse signal generation circuit is coupled to the common node, wherein the voltage of the common node is determined by a higher one of the first output and the second output.

12. The control circuit of claim 7, wherein the predetermined voltage is lower than a normal operating level of the output voltage when the light emitting device circuit is in the normal operation and normally connected.

* * * * *